US005150826A

United States Patent [19]

Logtens

[11] Patent Number: 5,150,826

[45] Date of Patent: Sep. 29, 1992

[54] APPARATUS FOR FORMING AND DRIVING STAPLES

[75] Inventor: Jozef P. M. Logtens, Meerlo, Netherlands

[73] Assignee: Xerox Corporation, Stamford, Conn.

[21] Appl. No.: 666,161

[22] Filed: Mar. 7, 1991

[30] Foreign Application Priority Data

Mar. 7, 1990 [GB] United Kingdom ..... 9005114

[51] Int. Cl.[5] ..... B25C 5/08

[52] U.S. Cl. ..... 227/88; 227/120

[58] Field of Search ..... 227/85, 87, 88, 89, 227/120

[56] References Cited

U.S. PATENT DOCUMENTS 4,444,347 4/1984 Males ..... 227/88

4,471,897 9/1984 Genyk et al. ..... 227/88

*Primary Examiner*—Douglas D. Watts

*Assistant Examiner*—Scott A. Smith

*Attorney, Agent, or Firm*—Kevin R. Kepner

[57] ABSTRACT

An apparatus for forming and driving staples in a single stroke includes a former (4) for forming staples from pre-cut lengths of staple wires, a forming block around which each staple wire is bent by the former, and a driver (3) for driving each formed staple into a workpiece. The former (4) and driver (3) each comprise a substantially flat plate, with the driver slideable within a cut-out portion (33) of the former, and with both plates having their two major surfaces in sliding contact with parallel, spaced apart, guide plates (5, 6). A common driving member (7) is linked to the driver (3) and disengageably linked to the former (4) by means of a retractable link pin (38). The driving member (7) is arranged to initially drive the driver and former together to form a staple around the forming block. Once the staple has been formed, the forming block is withdrawn from within the formed staple. The driving member (7) is disengaged from the former (4) at a predetermined point during the driving stroke after which the driving member drives only the driver (3), so that the driver moves relative to the former to drive the formed staple into the workpiece.

5 Claims, 7 Drawing Sheets

APPARATUS FOR FORMING AND DRIVING STAPLES

Cross-reference is made to a related application of the same title, inventor, filing date and assignee, application Ser. No. 07/666,274.

This invention relates to an apparatus for forming and driving staples, and is particularly, although not exclusively, concerned with a stapler that is useful for automatic stapling of stacks of paper sheets which are output from a printer or copier such as a xerographic copier.

The stapler of the invention is of the kind which forms and drives staples in a single stroke of its operating mechanism, and includes a former for forming staples from pre-cut lengths of staple wires, a forming block around which each staple wire is bent by the former, and a driver for driving each formed staple into a work piece.

There are two main types of known staples in which staples are both formed and driven by the stapler. In a first kind, lengths of the staple wire are cut as required from a continuous reel of wire by a cutting mechanism within the stapler. This kind of stapler requires wire feeding and cutting devices to be incorporated, thereby increasing its complexity and cost. In a second kind of stapler, pre-cut staple wire lengths are supplied in the form of a belt or web, secured side by side in a continuous strip by adhesive, or by being secured to a tape of, for example, a plastics material. An example of such a belt of staple wires, in which a length of the belt is formed into a coil, is described in U.S. Pat. No. 3,335,856. Staplers or tackers using such a coiled belt of staple wires are described in U.S. Pat. Nos. 3,009,156; 3,524,575; 4,542,844; and EP-B-0 059 713. As an alternative to a coiled belt of staple wires, the stapler described in U.S. Pat. No. 4,623,082 uses a cartridge containing a stack of staple wire sheets which are fed in succession by a sheet feed arrangement through a slot in a bottom end of the cartridge, to bring each staple wire in turn to the stapling head of the stapler.

The known staplers suffer from a variety of disadvantages. They generally include a large number of parts, some of which are rather complex and therefore expensive to produce. The driver and former mechanism, as well as the forming block, or anvil, around which the staples are formed, are susceptible to wear, giving rise to an increasing likelihood of jamming during the lifetime of the device. Previous attempts to simplify the design have led to the problem that reliability has been sacrificed, and that in the case of staplers for stacks of sheets, there is rather a low limit to the number of paper sheets which can successfully be stapled together.

The present invention is intended to provide a less complex and less expensive stapler which will nevertheless accommodate and successfully staple together a thicker stack of sheet than hitherto, while at the same time overcoming some of the problems caused by wear of the working parts.

According to the present invention there is provided an apparatus for forming and driving staples in a single stroke, including a former for forming staples from pre-cut lengths of staple wires, a forming block around which each staple wire is bent by the former, and a driver for driving each formed staple into a workpiece, characterized in that the former and driver each comprise a substantially flat plate, with the driver slideable within a cut-out portion of the former, and with both plates having their two major surfaces in sliding contact with parallel, spaced apart, guide plates, that a common driving member linked to the driver and disengageably linked to the former is arranged to initially drive the driver and former together to form a staple around the forming block, that means are provided for withdrawing the forming block from within the formed staple, and that means are provided for disengaging the driving member from the former at a predetermined point during the driving stroke whereafter the driving member drives only the driver, whereby the driver moves relative to the former to drive the formed staple into the workpiece.

A stapler in accordance with the present invention will now be described, by way of example, with reference to the accompanying drawings in which.

CONSTRUCTION

Figure 1:
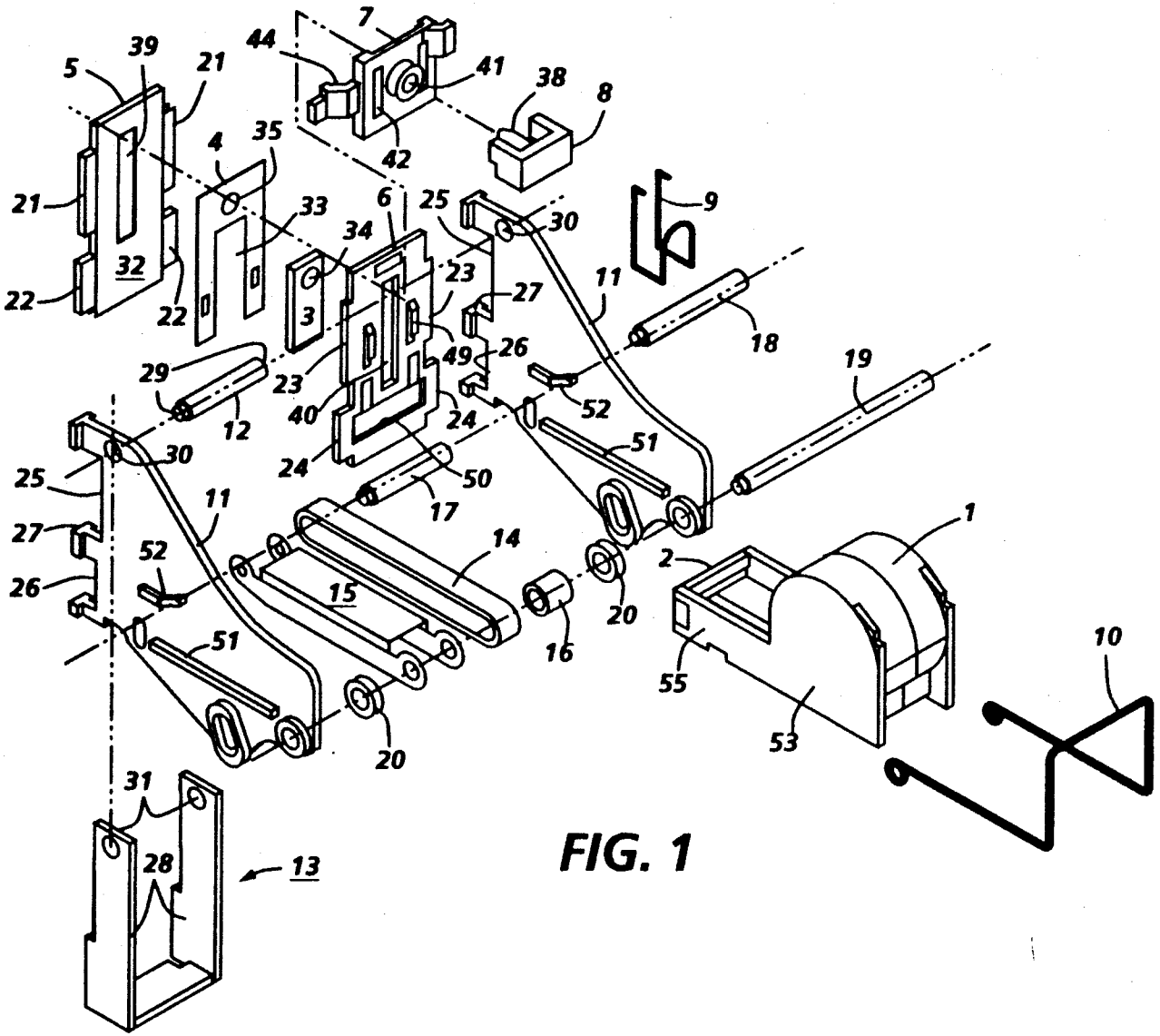
FIG. 1 is an exploded perspective view of the stapler.
Figure 2:
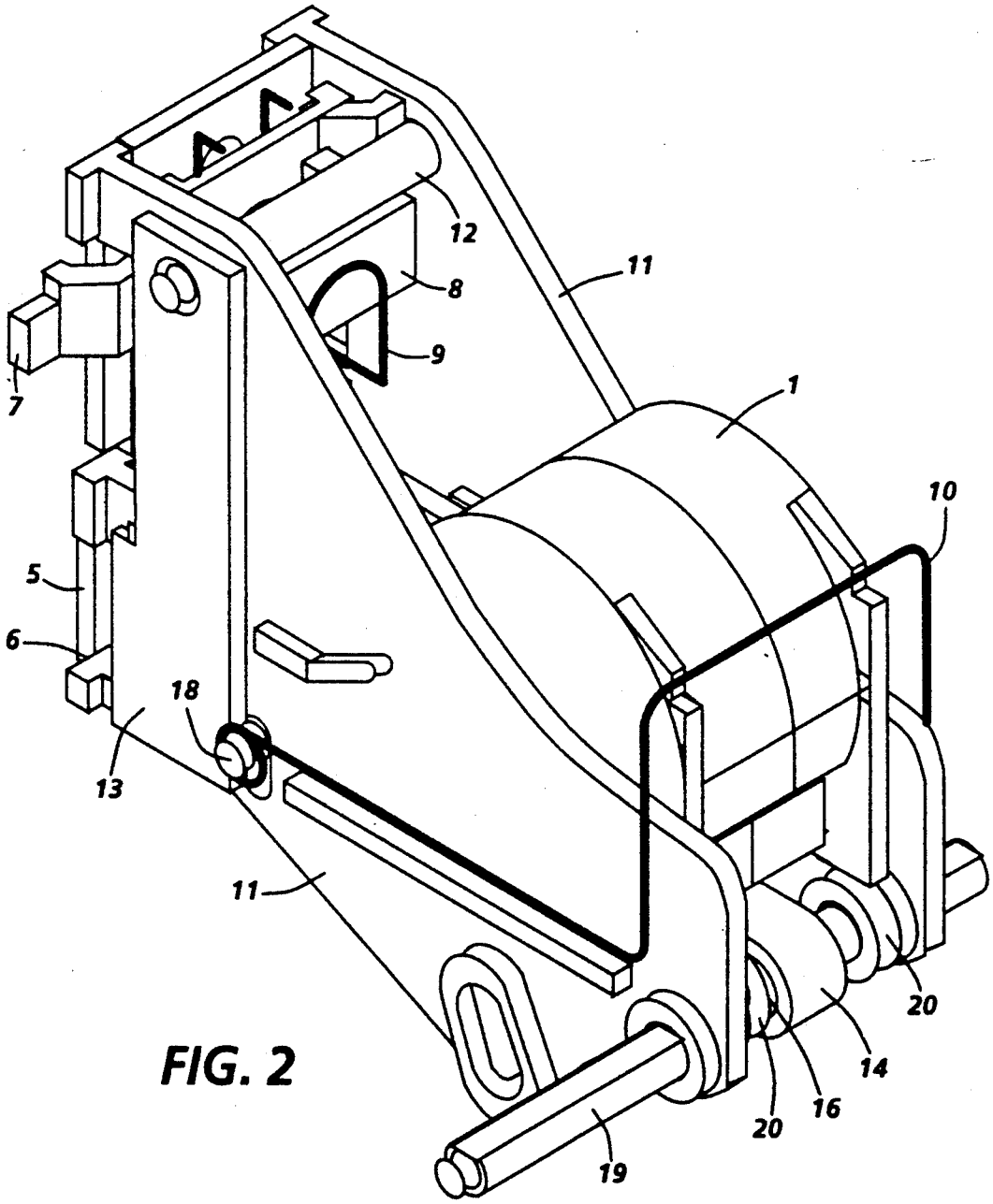
FIG. 2 is a rear perspective view of the stapler.

The main frame of the stapler consists of two side frame members 11, a front plate 5, a rear plate 6, a bracket 13, and a shaft 12. The front plate 5 has upper and lower side lugs 21 and 22, and the rear plate 6 has corresponding upper and lower side lugs 23 and 24. The front and rear plates are located between side plate members 11 by their side lugs which fit into indents 25 and 26 on the vertical front edges of the side frame members 11. The front and rear plates 5 and 6 are effectively clamped together by transverse end stops 27 formed on the front edges of the side frame members 11. Bracket 13, which is U-shaped, has a vertical arm 28 adjacent each outside face of the side frame members 11, and is shaped to engage corresponding features, as provided, for example, by end stops 27, of the side frame members 11. The shaft 12 has shouldered ends 29 which fit into holes 30 in the side frame members 11 and are secured there by screws (not shown). Holes 31 in the arms 28 of bracket 13 are slightly larger than holes 30 to allow for any necessary horizontal or vertical adjustment. The shaft 12 and bracket 13 thus lock the four parts of the main frame together.

The front plate 5 has a parallel-sided recess or channel 32 (best seen in FIGS. 6) which extends over its full height and which is of suitable depth such that a staple former 4 and a staple driver 3, both of which are substantially flat plates of the same thickness, are a close sliding fit between the channel 32 and the front face of rear plate 6. The former 4 has a parallel sided cut out portion 33, open to the bottom of the former 4, to accommodate the rectangular driver 3. The vertical edges of the driver 3 are a close sliding fit within the cut-out portion 33 of the former 4. The driver 3 and former 4 have holes 34 and 35 respectively near their upper ends, for engagement by pins 37 and 38 of a driving member 7 (see FIG. 5). Front plate 5 and rear plate 6 have aligned, centrally located vertical slots 39 and 40 respectively to accommodate the pins 37 and 38 when the pins are in engagement with the holes 34 and 35 respectively of the driver 3 and former 4.

Figure 5:
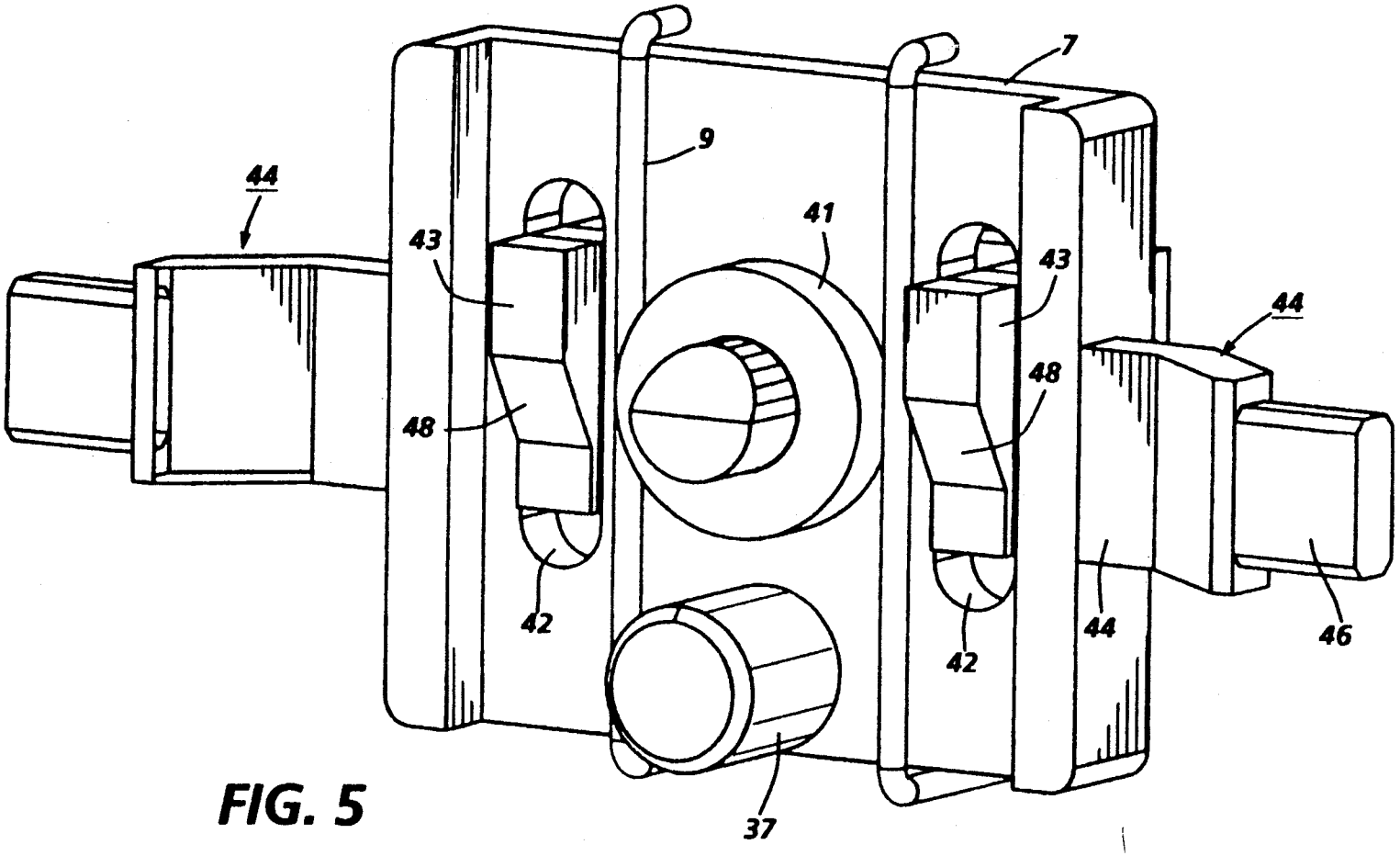
FIG. 5 is a front perspective view of the driving member of the stapler.
Figure 6:
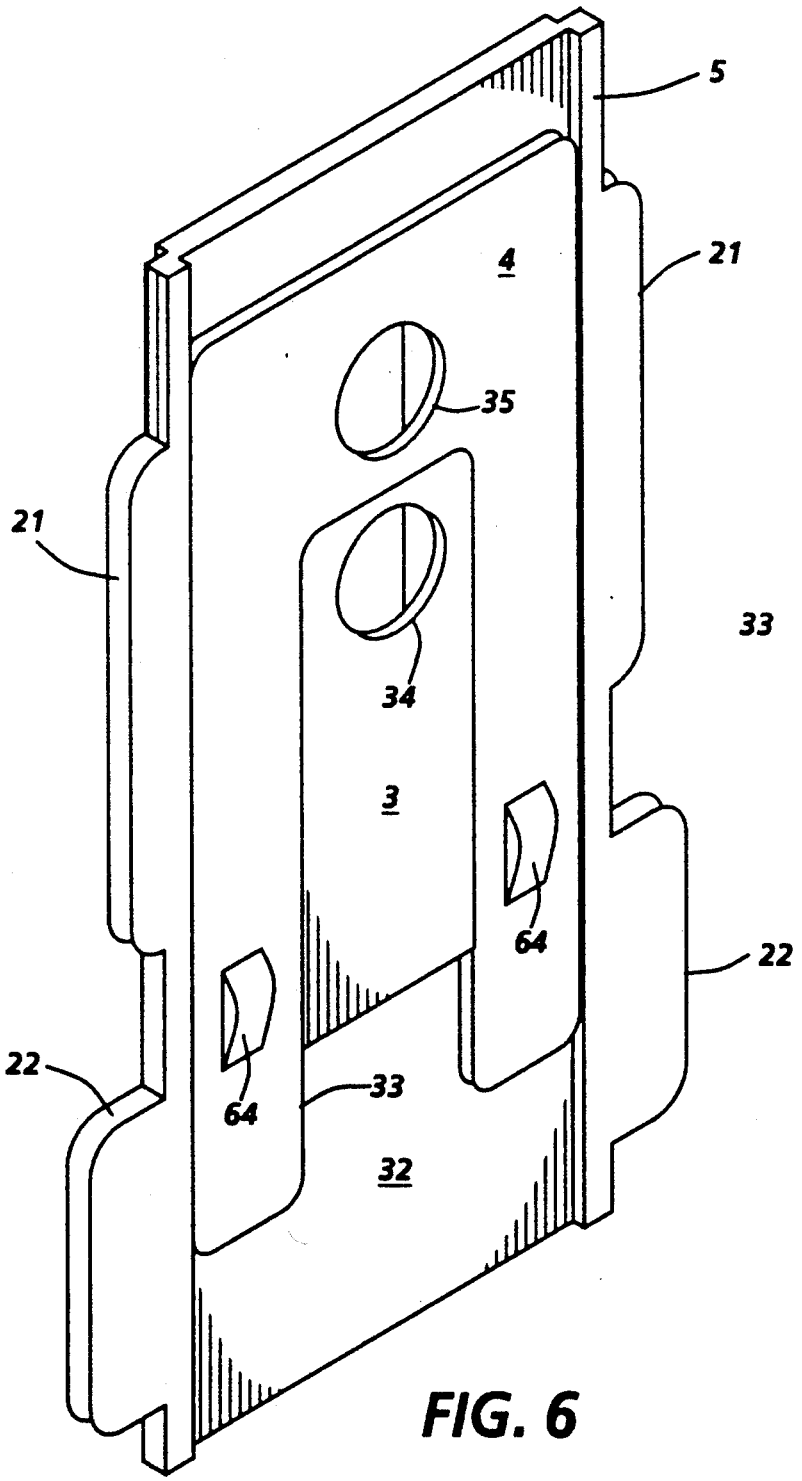
FIG. 6 is a rear perspective view of the staple driver, the stapler former, and the front guide plate of the stapler.

The driving member 7, as shown in FIG. 5, has a central boss 41, in which pin 38 is a sliding fit, and two vertical slots 42, one on each side of the boss 41. The pin 38 is carried by a yoke 8, the two arms 43 of which are slideable (horizontally) within slots 42. The yoke 8, and therefore the pin 38, is spring urged towards the front of the stapler by means of a spring 9 which clips around driving member 7 and yoke 8. Driving member 7 is held for vertical sliding movement against the rear surface of rear plate 6 by means of lateral arms 44, the inner portions 45 of which are held for sliding movement between the upper side lugs 23 of rear plate 6 and the front edges of the upper indents 25 of the side frame members 11. The outer portions 46 of lateral arms 44 are used to connect the driving member 7 to a driving mechanism such as a solenoid or an electric motor in the case of an automatic stapler, or to a hand operated plunger for a manually operated stapler. Examples of suitable drive mechanisms operated by an electric motor are to be found in U.S. Pat. Nos. 4 623 082 and 4 720 033.

The front faces of arms 43 of yoke 8 are tapered to form cam follower surfaces 48 which cooperate with raised cam portions 49 on the rear surface of rear plate 6. Thus, as driving member 7 is driven downwards, the pin 38 is retracted rearwards when cam follower surfaces 48 engage the raised cam portions 49, thereby disengaging pin 38 from the hole 35 in former 4. The fixed pin 37 of driving member 7, on the other hand, remains engaged with the hole 34 in driver 3 at all times.

Figure 3:
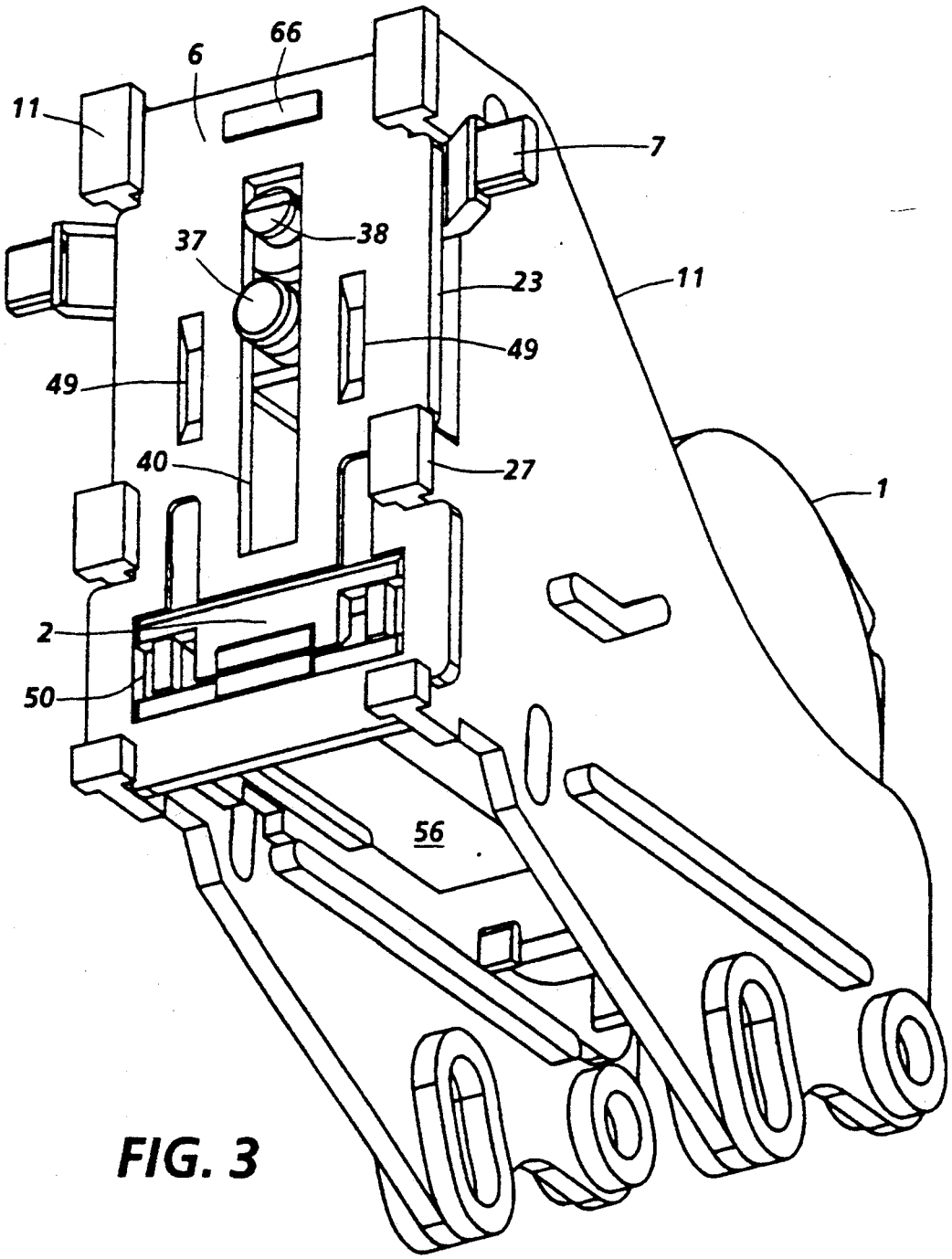
FIG. 3 is a front perspective view, from below.
Figure 4:
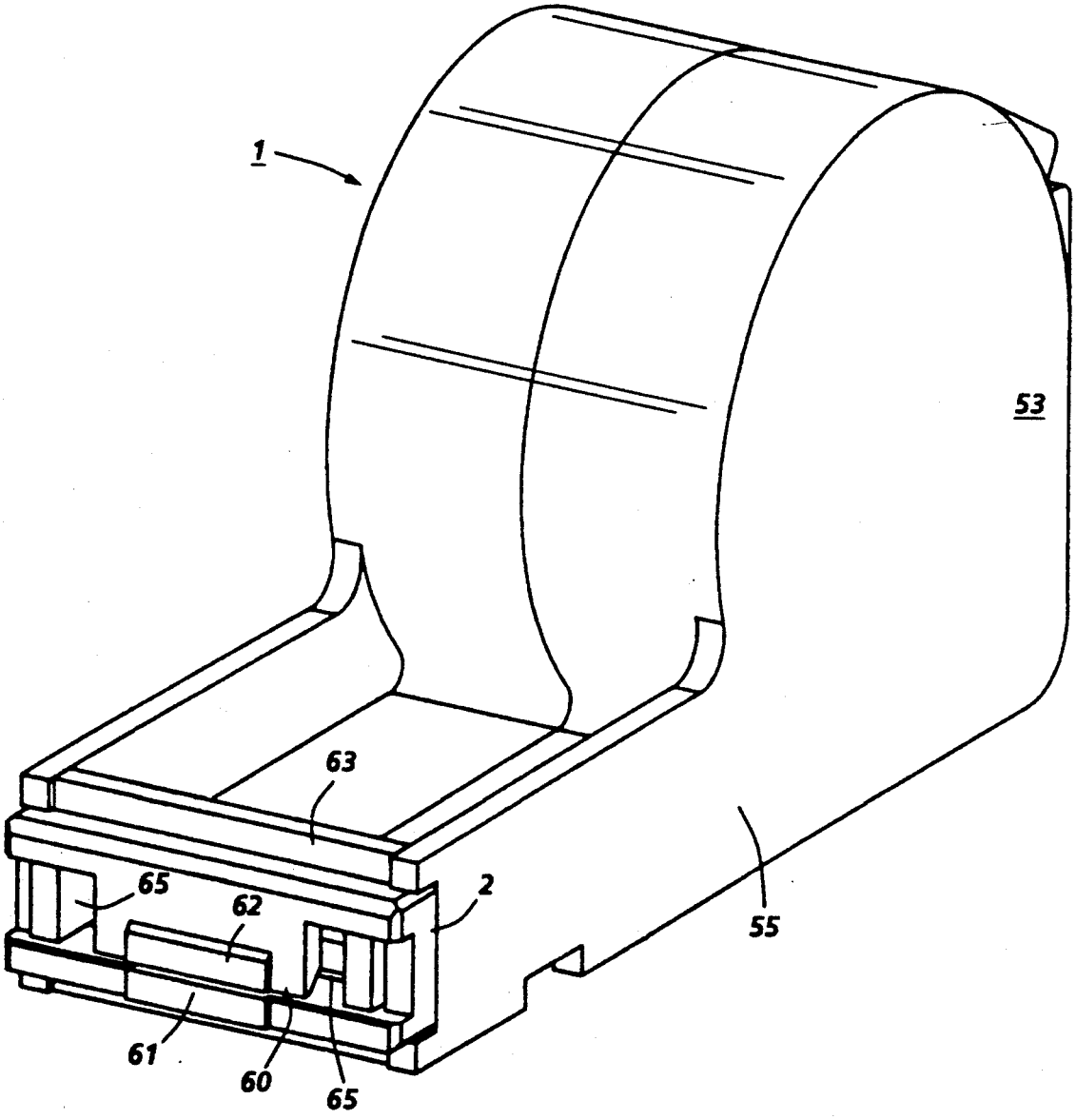
FIG. 4 is a perspective view of a cartridge for staple wires for use in the stapler.

Staple wires are introduced into the stapling head (the stapling head comprising the front and rear plates 5 and 6, the driver 3 and the former 4) through a rectangular slot 50 in the lower part of rear plate 6. Staple wires are delivered from a cartridge 1 which has a front portion, or nose, 2 adapted to pass through slot 50 in rear plate 6. The cartridge is supported and properly positioned in the stapler by means of ribs 51, 52 of side frame members 11. The cartridge, as best seen in FIG. 4, includes a container portion 53, for containing a coiled band 54 of staple wires (FIG. 7), and a feed throat 55. The feed throat 55 is closed above, but partially open below to provide an access opening 56 (FIG. 3) through which a feed mechanism may contact the lower surface of the staple wire band 54 to urge it towards the stapling head. The feed mechanism comprises an endless belt 14 which is mounted in a belt carrier 15 for rotation around rollers 16 and 17. Rollers 16 and 17, as well as the ends of belt carrier 15, are carried by shafts 19 and 18 respectively which in turn are supported by side frame members 11. Shaft 19, which also carries spacing rollers 20 on either side of roller 16, is driven so as to drive belt 14 slowly but continuously. The forward end of belt 14, as it passes around roller 17, is urged gently upwards into contact with the underside of the staple wire band 54. A releasable spring retainer 10, which is mounted at its forward, looped, ends on the two ends of shaft 18, serves both to releasably retain the cartridge 1 in its operative position and to urge the forward end of belt 14 upwardly into contact with the underside of staple band 54. The rear end of spring retainer 10 clips into notches in the cartridge 1, and generally horizontal portions of the spring retainer extend along the sides of the cartridge, close to ribs 51, the ribs 51 providing reaction surfaces for the spring.

Referring to FIG. 4, the nose 2 of the cartridge is secured to the forward end of the feed throat 55 of the cartridge. Staple wires emerge through slot 60 in nose 2, with the first, or leading staple wire coming to rest (by virtue of it abutting against the rear surface of front plate 5) in the stapling head. A forming block 61 is provided by a forward protrusion just below the slot 60, and a matching upper protrusion 62 is positioned just above the slot 60. The uppermost front edge 63 of the nose 2 is chamfered to provide a camming surface which is engaged by protrusions 64 (FIG. 6) on the rear surface on the former 4 at an appropriate point in the downward movement of the former, thereby pushing back the cartridge so as to effectively pull the leading staple out of the cartridge.

Although no staple clinching mechanism has been described, it will be understood by those skilled in the art that any of the many known forms of passive or active clinching mechanism may be used. Alternatively, if the stapler is to be used as a staple gun, or tacker, no clinching mechanism is needed.

OPERATION

Figure 7:
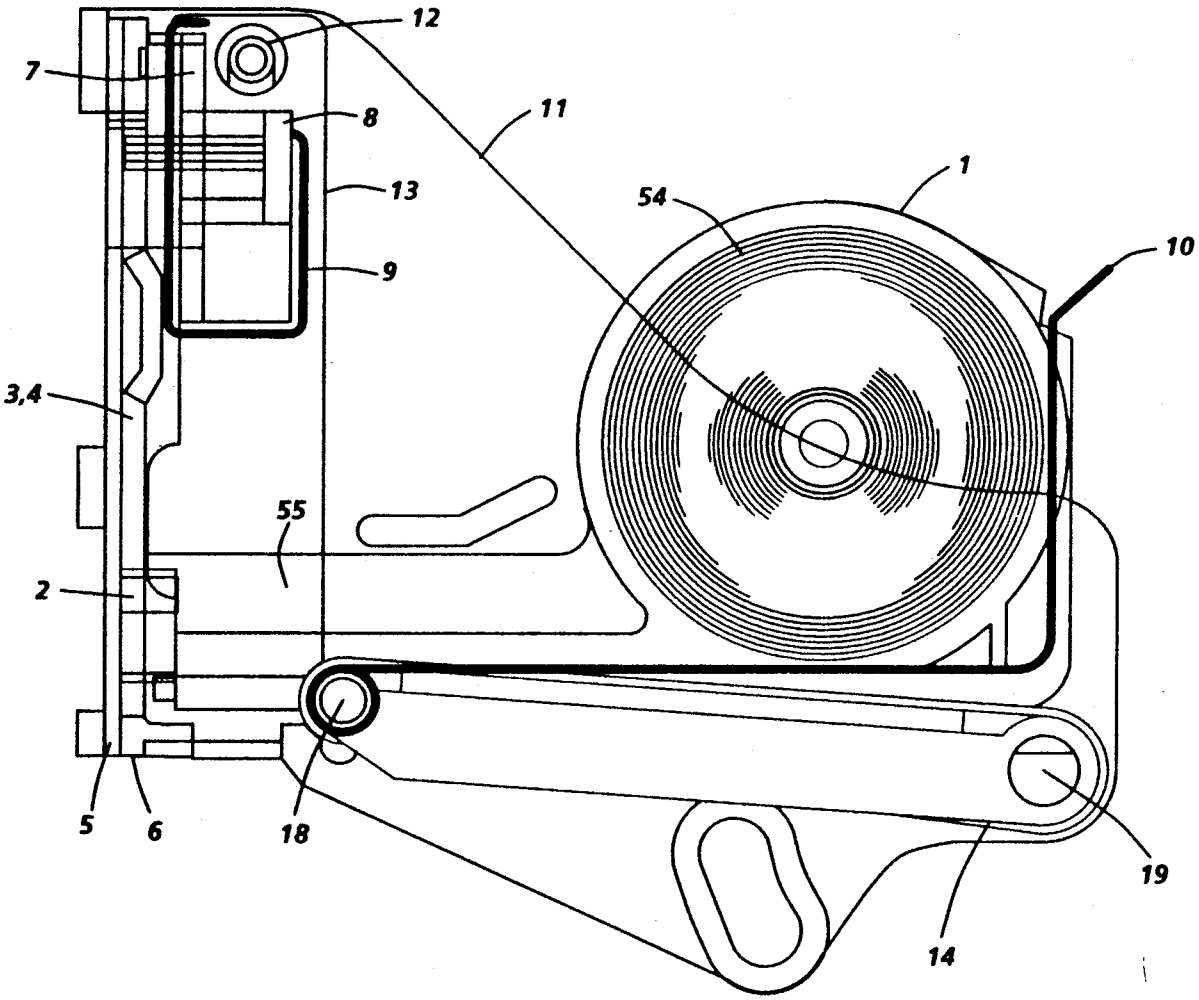
FIG. 7 is a cross-sectional side view of the stapler.

The cartridge 1 is placed between the two side frame members 11 and is pushed towards the front of the stapler until the protrusion 61 and 62 of the nose 2 are touching the rear of the front plate 5 within channel 32. The leading staple wire of the staple wire band 54 should be flush with, or somewhat back from, the nose 2 of the cartridge before the cartridge is inserted into the stapler. The spring retainer 10 is clipped into place over the cartridge, and forces the cartridge into the forward position described, and at the same time pushes the drive belt 4 upwards against the underside of the staple belt (FIG. 7).

With the stapler in its standby position, the driving member 7 is pushed upwards by a spring (not shown) which in turn pushes the driver 3 upwards against the former 4. The former 4 is stopped in the upward direction by a stop 66 (FIG. 3) on the rear plate 6. The pin 37 of driving member 7 just fits in the hole 34 of driver 3. The pin 38 of yoke 8 on the other hand has some clearance within the hole 35 in the former 4.

When the driving member 7 is coupled with the drive mechanism (not shown) of the drive shaft 19 and this drive shaft starts turning, the following will happen: if the leading staple wire is not flush with the front of nose 2 of the cartridge 1, this leading wire will be transported by the drive belt 14 until it abuts against the surface of channel 32 of front plate 5. The driving member 7 starts moving down and the driver 3 follows immediately, with the former 4 following a very short time later due to the clearance of pin 38 in the hole 35 of the former 4. After a predetermined amount of travel, the former 4 will touch the leading staple wire which is located between the upper part 62 (FIG. 4) and the forming block 61 of the nose 2 thereby forming the staple around the forming block 61. The protrusions 64 (FIG. 6) on the former 4 are positioned such that the staple is formed before they hit the chamfered section 63 (FIG. 4) of the nose 2. Once the protrusions 64 hits the chamfered section 63, the 2 (and hence the cartridge) is pushed backwards while the formed staple with the rest of the staple belt stay where they are. This gives clearance to the driver 3 to pass the upper part 62 of the nose 2 without touching it. Due to the contour of the protrusions 64, and by virtue of openings 65 in the nose 2, the cartridge can move inwards again just before the driver 3 hits the formed staple. This ensures that at this moment the upper part 62 of the forming block is pushing against the driver 3. This position of the nose 2 is necessary to guarantee a clean cut of the staple wire band the driver 3 when it moves further down.

The bottom edge of the former 4 will at a certain time reach its end position which is close to the paper stack through which the staple is to be driven. At this moment the cam follower surfaces 48 (FIG. 5) of the yoke 8 are touching the raised cam portion 49 of the rear plate 6, and the yoke 8 is pushed backwards thereby disconnecting the pin 38 from the hole 35 in the former 4. The former thus stops moving.

The driving member 7 and yoke 8 move further down together with the driver 3 driving the formed staple into the paper stack. The legs of the former 4, the front plate 5 and the back plate 6 act as a guide for the staple legs during penetration into the paper. After this full stroke the driving member 7 moves upwards together with yoke 8 and driver 3. The former 4 may move with it immediately due to friction between it and the driver, but will be stopped at a certain position by the stop 66 on the rear plate 6 and will wait in this position for engagement by the pin 38 of the yoke 8. If the former 4 does not move immediately upwards during the return stroke of the driving member 7, engagement with the pin 38 will take place more or less at the same position as the disengagement. The nose 2, with the cartridge 1, now moves forwards again under pressure of the spring retainer 10 just as the former and driver have cleared the area so that the stapler is ready for the next cycle.

The stapler of the invention has a number of advantages, as follows. In common with other coiled staple wire band staplers, it provides a continuous supply of staples, without possible difficulties caused by feeding a succession of sheets of staples. Staples are fed primarily by the backward and forward movement of the cartridge. The frictional drive belt beneath the cartridge is only a safety device in case the leading staple wire is not flush with the nose of the forming block at the beginning of a cycle. The former and driver are very simple, flat plate parts which always move in the same plane, which is closely defined by the front and rear plates 5 and 6. The former and driver do not ride over each other at any point during a stapling cycle, as in some of the known staplers, thereby preventing wear on their functional areas. Only two extra parts (the yoke 8 and spring 9) are needed to establish the engagement and disengagement of the former and driver from the driving member. The addition of these parts is a very minor penalty compared with the advantages of having very simple moving parts which do not have to ride over one another. The staple wire band, once it is in place in the nose of the cartridge, stays there. It does not have to leave the nose again. Furthermore, the fact that the nose forms part of the cartridge and that the forming block is part of the nose, means that each time a cartridge is exhausted a new forming block is brought in to play. This considerably reduces problems caused by wear of the forming block.

I claim:

1. Apparatus for forming and driving staples in a single stroke, comprising:

a removable cartridge storing staple wire;

a first guide plate having a planar surface;

a second guide plate having a planar surface, said second guide plate being spaced apart from, and parallel to the first guide plate to define a guide channel between the planar surface of the first guide plate and the planar surface of the second guide plate and wherein said first guide plate defines a slot;

a former defining a cut-out portion adapted to form staples from the staple wire stored in the removable cartridge;

a forming block having staple wire bent thereabout by the former to produce a staple;

a driver for driving the staple into a workpiece, wherein the former and the driver each comprise a substantially flat plate of equal thickness, with the driver comprising a substantially rectangular plate aligned in the same plane as, and slideable within the cut-out portion of the former, and with both the former and the driver being arranged for coplanar sliding movement in the guide channel;

means for withdrawing the forming block from the staple;

a driving member defining an aperture;

a first link member attached to the driving member; and a second link member within the aperture of and slideably attached to the driving member wherein the first link member extends through the slot in the guide plate for linking the driving member to the driver and the second link member extends through the slot for disengagingly linking the driving member to the former to initially drive the driver and former in unison to form the staple around the forming block and wherein said second link member is a retractable link member so that at a predetermined point during the driving stroke whereafter the driving member drives only the driver, so that the driver moves relative to the former to drive the staple into the workpiece.

2. Apparatus according to claim 1 wherein said retractable link member comprises:

a cam portion on the guide plate having the slot;

a pin slideably mounted in the aperture in the driving member;

a member coupled to the pin, said member being adapted to slide on the guide plate having the slot and contact the cam portion of said guide plate so that the pin is disengaged from the former by the action of the member on the cam portion of the guide plate having the slot.

3. Apparatus according to claim 1, further comprising an operator removable cartridge storing staple wire.

4. Apparatus according to claim 3, wherein the forming block is mounted on the removable cartridge.

5. Apparatus according to claim 1, further including means for withdrawing the forming block from within the staple.

* * * * *